US011480133B2

(12) United States Patent
Wu et al.

(10) Patent No.: US 11,480,133 B2
(45) Date of Patent: Oct. 25, 2022

(54) SCROLL HEATING DEVICE

(71) Applicant: NATIONAL CHENG KUNG UNIVERSITY, Tainan (TW)

(72) Inventors: Chih-Yung Wu, Tainan (TW); Wen-Lih Chen, Tainan (TW)

(73) Assignee: NATIONAL CHENG KUNG UNIVERSITY, Tainan (TW)

( * ) Notice: Subject to any disclaimer, the term of this patent is extended or adjusted under 35 U.S.C. 154(b) by 124 days.

(21) Appl. No.: 17/140,617

(22) Filed: Jan. 4, 2021

(65) Prior Publication Data

US 2022/0136456 A1 May 5, 2022

Related U.S. Application Data

(60) Provisional application No. 63/108,452, filed on Nov. 2, 2020.

(51) Int. Cl.
*F02G 1/055* (2006.01)
*F23C 3/00* (2006.01)
(Continued)

(52) U.S. Cl.
CPC ..... *F02G 1/055* (2013.01); *F23C 3/00* (2013.01); *F23L 15/04* (2013.01);
(Continued)

(58) Field of Classification Search
CPC .. F02G 1/055; F02G 2254/10; F02G 2254/05; F02G 2254/11; F02G 2254/15; F02G 2254/18; F02G 2254/70; F02G 2258/10; F02G 5/02; F02G 2260/00; B60H 1/18; F23C 2900/13001;
(Continued)

(56) References Cited

U.S. PATENT DOCUMENTS 1,799,039 A * 3/1931 Conejos ..... F28D 21/0008 126/104 A
3,302,683 A * 2/1967 Kemp ..... F23D 14/00 165/909
(Continued)

FOREIGN PATENT DOCUMENTS

EP 328794 A1 * 8/1989
JP 62178756 A * 8/1987
(Continued)

*Primary Examiner* — Mickey H France
(74) *Attorney, Agent, or Firm* — WPAT, PC

(57) ABSTRACT

A scroll heating device includes a base, a reaction region, and a first and a second channel. The reaction region is at the center of the base. The two channels are located on the base and extend spirally from the reaction region toward the periphery of the base. The width of each channel is gradually reduced as the channel extends from adjacent to the center of the base toward the periphery of the base. The first channel allows a gas that flows into the first channel through the periphery of the base toward the center of the base to flow toward the reaction region at a progressively slower rate, enter the reaction region slowly through the gradually widening first channel, and therefore stay in the reaction region for longer. The combusted exhaust enters the second channel from adjacent to the center of the base and exits through the periphery of the base.

10 Claims, 7 Drawing Sheets

(51) Int. Cl.
*F23L 15/04* (2006.01)
*F23C 13/08* (2006.01)

(52) U.S. Cl.
CPC ..... *F02G 2254/15* (2013.01); *F02G 2254/18* (2013.01); *F02G 2254/70* (2013.01); *F02G 2258/10* (2013.01); *F23C 13/08* (2013.01); *F23C 2900/13001* (2013.01); *F23C 2900/99011* (2013.01); *F23N 2221/08* (2020.01)

(58) Field of Classification Search
CPC .. F23C 2900/99011; F23C 13/08; F23C 7/00; F23C 7/002; F23C 7/04; F23C 7/06; F23C 3/00; F23L 3/00; F23L 15/04; F23L 15/02; F23N 2221/08; F23M 9/02; F02M 31/087; F02M 31/093; F02M 31/06; F02M 31/08; F02M 31/0815; F02M 31/0825; F02M 2700/4345; F28D 21/0003; F01N 5/02
USPC ..... 60/512, 515, 524; 126/265, 271.2 R; 431/11, 103, 115, 116, 215; 165/52; 432/133
See application file for complete search history.

(56) References Cited

U.S. PATENT DOCUMENTS 3,812,826 A * 5/1974 Lear ..... F23M 9/06 122/367.1
3,854,530 A * 12/1974 Jouet ..... B21D 53/027 165/110
4,639,212 A * 1/1987 Watanabe ..... F02G 1/055 60/517
4,865,542 A * 9/1989 Hasenack ..... C10J 3/506 239/132.3
4,911,894 A * 3/1990 Retallick ..... F02M 31/13 422/177
5,220,955 A * 6/1993 Stokes ..... F04D 29/5826 165/122
5,252,299 A * 10/1993 Retallick ..... A62B 11/00 502/527.22
5,326,537 A * 7/1994 Cleary ..... B09C 1/06 422/204
5,922,178 A * 7/1999 Isenberg ..... B01D 53/00 204/266
6,282,371 B1 * 8/2001 Martin ..... F01N 3/2817 422/168
6,532,339 B1 * 3/2003 Edgar ..... F24H 1/0045 392/491
6,613,972 B2 * 9/2003 Cohen ..... F23C 3/00 136/211
6,814,132 B1 * 11/2004 Ike ..... F28D 9/04 165/165
6,840,762 B2 * 1/2005 Maruta ..... F23D 14/66 431/170
6,951,456 B2 * 10/2005 Cohen ..... H01L 35/00 136/211
7,025,119 B2 * 4/2006 Ike ..... F28D 9/04 165/165
7,135,154 B2 * 11/2006 Deshpande ..... B01J 19/2485 422/204
7,316,563 B2 * 1/2008 Marshall ..... F23C 13/00 431/243
8,479,508 B2 * 7/2013 Roychoudhury ..... F23C 13/08 60/524
9,595,726 B2 * 3/2017 Chen ..... C01B 3/36
10,557,391 B1 * 2/2020 Chen ..... F01N 3/2013
2002/0172905 A1 * 11/2002 Ruck ..... F23C 9/006 431/354
2011/0011079 A1 * 1/2011 Kamen ..... F25B 9/14 60/660
2011/0100027 A1 * 5/2011 Schnell ..... G01R 33/3403 324/318
2018/0320518 A1 * 11/2018 Wei ..... F01B 7/16
2019/0041091 A1 * 2/2019 Movassaghi ..... F23M 9/06
2020/0370446 A1 * 11/2020 Mook ..... F02G 1/045

FOREIGN PATENT DOCUMENTS

JP 2014114977 A * 6/2014
WO WO-2020022936 A1 * 1/2020

* cited by examiner

SCROLL HEATING DEVICE

CROSS REFERENCE

This non-provisional application claims the benefit of American Provisional Application No. 63/108,452, filed on Nov. 2, 2020, the contents thereof are incorporated by reference herein.

BACKGROUND OF THE INVENTION

1. Technical Field

The present invention relates to a heating device and more particularly to a scroll heating device.

2. Description of Related Art

A Stirling engine is a highly efficient external combustion energy converting device and can be driven into operation by a heat source (such as solar energy, waste heat, nuclear raw material, cow manure, propane, natural gas, biogas (methane), butane, petroleum, or other fuels) as long as the temperature of the heat source is high enough. Unlike such internal combustion engines as gasoline engines and diesel engines, which require the use of specific fuels, Stirling engines need less maintenance and are more efficient, quieter, and more reliable.

The conventional Stirling engines absorb the heat of an external heat source through a heat exchanger and use heat pipes to increase heat transfer efficiency. However, the combustion efficiency of a heat source for use with a Stirling engine tends to be compromised by the dissipation of hot air during the heating process, and the pressure on the internal structure of the heat source varies greatly during the same process. Moreover, there are limitations on the mechanical structure and weight of a heat exchanger for use with a Stirling engine. A heat exchanger with a thin base has relatively high thermal conduction efficiency but relatively low structural strength. A heat exchanger with a thick base is enhanced in structural strength but has relatively low thermal conduction efficiency. While thermal conduction efficiency can be increased by way of heat pipes, the heat pipes result in an increase in cost as well as bulkiness, both drawbacks demanding improvement.

An appropriate temperature and proper thermal conduction are important to the operation of a Stirling engine. It is therefore crucial to provide a Stirling engine with a heat source that has an appropriate temperature for driving the Stirling engine. Furthermore, combustion through catalyst-assisted low-temperature oxidation has been a research topic in the combustion science for many years, the greatest challenge being to oxidize a low-level fuel completely so as to obtain chemical energy therefrom.

The shortage and rising cost of energy resources, plus environmental issues such as global warming, have spurred the research and development of devices for use with Stirling engines. Currently, however, we are still in want of products that, on the one hand, incorporate a combustor with a thermally conductive base and, on the other hand, are designed for low-level fuels in order to meet the demand of using sustainable-carbon-economy fuels, biogas produced in crop/livestock farming, and gasified biomass gas. It is imperative to provide better solutions than the prior art.

BRIEF SUMMARY OF THE INVENTION

One objective of the present invention is to provide a scroll heating device that includes a base, a reaction region, and a first and a second channel.

Another objective of the present invention is to improve the conventional heating device of a Stirling engine by providing a super thin heating end (base) that has a first and a second channel with a Swiss roll-like structure, wherein the first and the second channels have outstanding heat transmitting and retaining abilities and can transfer heat rapidly to a plurality of pin fins, help enhance the mechanical strength of the entire heating device, and solve the aforementioned problem of the conventional heat exchangers, namely inefficient thermal conduction attributable to the limitations imposed on the mechanical structure and weight of a conventional heat exchanger.

The reaction region is located at the center of the base. The first and the second channels are located on the base and extend outward of the reaction region. Each of the first and the second channels extends spirally from a starting point defined by the reaction region toward the periphery of the base. Each of the first and the second channels has a width that is gradually reduced as the channel extends from a position adjacent to the center of the base toward the periphery of the base; as a result, both channels become narrower toward the periphery of the base and wider toward the center of the base. The first channel, which gradually widens toward the center of the base, allows a gas flowing into the first channel to flow toward the reaction region at a progressively slower rate and then enter the reaction region slowly through the gradually widening first channel, thereby increasing the time for which the gas will stay in the reaction region. The combusted exhaust flows into the outer end (also called the third end below) of the second channel that is adjacent to the center of the base and exits through the inner end (also called the fourth end below) of the second channel that is located at the periphery of the base.

Preferably, the first and the second channels are arranged according to one or a combination of a Fermat's spiral configuration, a Vogel spiral configuration, and an Archimedean spiral configuration.

Preferably, the base includes a gas inlet and a gas outlet. The gas inlet is provided at the periphery of the base and is in communication with the first channel. The gas outlet is provided at the periphery of the base and is in communication with the second channel. The gas inlet and the gas outlet are located diametrically opposite each other.

Preferably, the scroll heating device further includes a plurality of pin fins, and the base further includes two opposite sides defined respectively as a first side and a second side. The pin fins are located on the first side and are spaced apart from one another. The first and the second channels are located on the second side.

Preferably, the scroll heating device further includes a cover provided on the second side to close the first and the second channels.

Preferably, the first channel has a first end adjacent to the center of the base and a second end located away from the center of the base and connected to the gas inlet, and the second channel has a third end adjacent to the center of the base and a fourth end located away from the center of the base and connected to the gas outlet.

Preferably, the first side and the second side define therebetween a thickness of 3 mm.

Preferably, the scroll heating device is made of a thermally conductive material, and the thermally conductive material is one or a combination selected from the group consisting of a metal, a metal alloy, and ceramic.

Preferably, the gas is one or a combination selected from the group consisting of dimethyl ether (DME), methane ($CH_4$), synthesis gas (syngas), natural gas, liquefied petroleum gas, and biogas.

Preferably, the scroll heating device is adapted to be coupled to the heating end of a Stirling engine.

The present invention can produce the following advantageous effects: A gas moving through the first channel to the reaction region can be preheated by the exhaust in the immediately adjacent turns of the second channel that flank each but the outermost turn of the first channel. In addition, the first channel, which gradually widens toward the center of the base, allows a gas flowing into the first channel to flow toward the reaction region at a progressively slower rate and then enter the reaction region slowly through the gradually widening first channel, thereby increasing the time for which the gas stays and burns in the reaction region. Moreover, when the exhaust moves through the second channel toward the gas outlet, the gas that is about to enter the reaction region is preheated by the exhaust. Thus, the scroll heating device transmits and retains heat and can reduce unnecessary heat dissipation and exergy destruction, allowing chemical energy to be converted into thermal energy stably. Also, the scroll heating device has no limitation on the type of the fuel gas used, meaning the scroll heating device can work with, and thus remove the limitations conventionally imposed on, low-heat-value gases that are difficult to burn directly, and this makes it possible to reuse energy effectively.

DETAILED DESCRIPTION OF THE INVENTION

The detailed description and preferred embodiments of the invention will be set forth in the following content, and provided for people skilled in the art to understand the characteristics of the invention.

Figure 1:
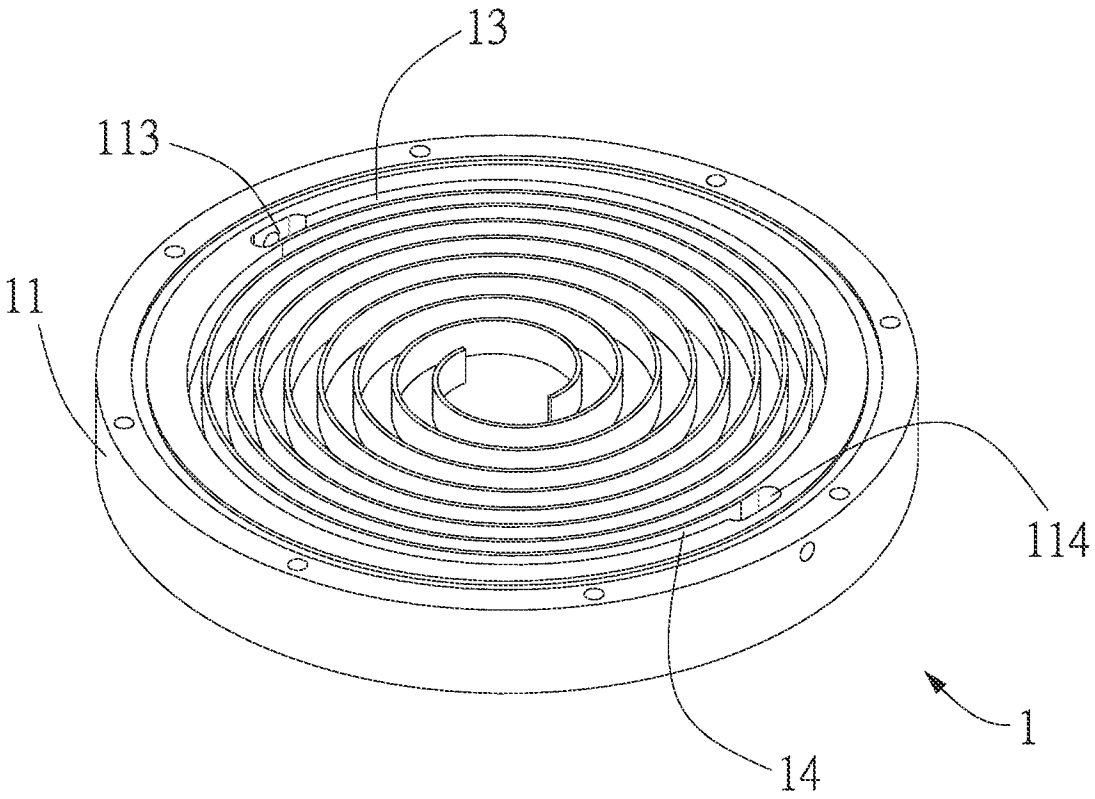
FIG. 1 is a perspective view of the scroll heating device according to a preferred embodiment of the present invention.
Figure 2:
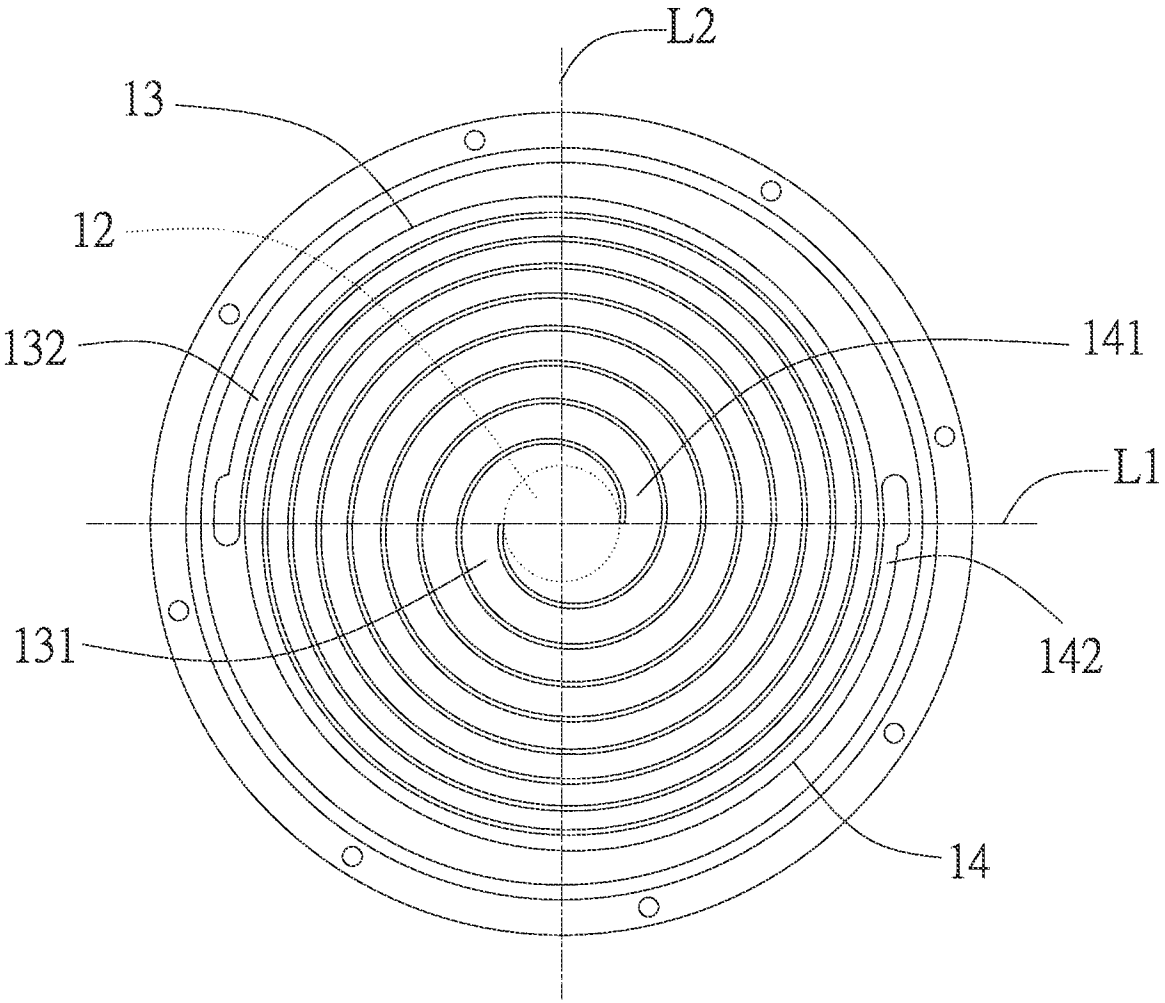
FIG. 2 shows the scroll heating device in FIG. 1 from another viewing angle.
Figure 3:
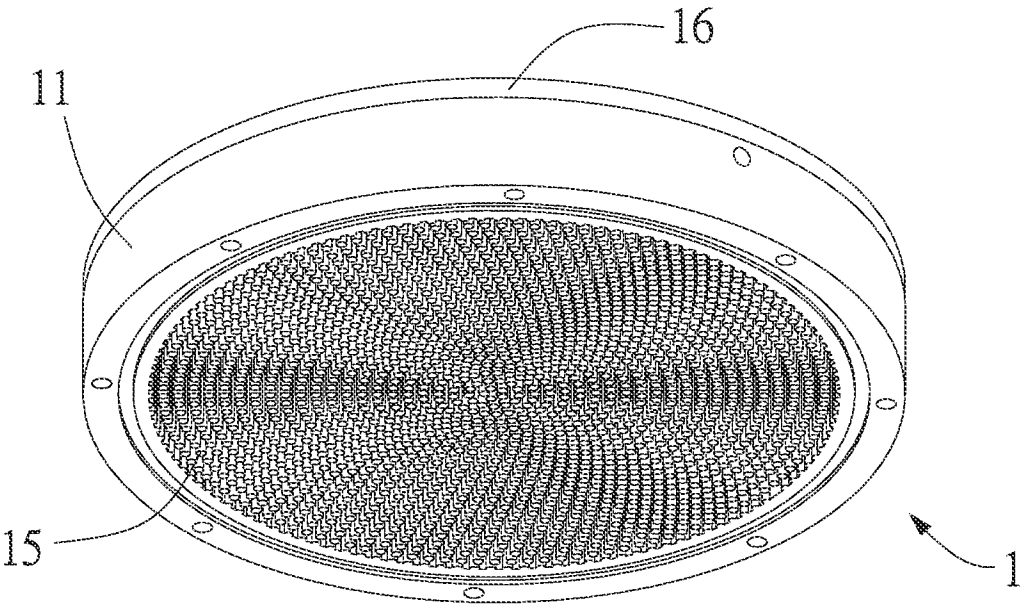
FIG. 3 shows the scroll heating device in FIG. 1 from yet another viewing angle.

Referring to FIGS. 1-3, the scroll heating device 1 according to an embodiment of the present invention includes a base 11, a reaction region 12, a first channel 13, a second channel 14, a plurality of pin fins 15, and a cover 16. The scroll heating device 1 is adapted to be coupled to the heating end of a Stirling engine 9 (see FIG. 6).

The scroll heating device 1 is made of a thermally conductive material. The thermally conductive material may be one or a combination selected from the group consisting of a metal, a metal alloy (preferably stainless steel, an aluminum alloy, etc.), and ceramic, and is preferably resistant to temperatures as high as 933 K. Due to its good thermal conductivity, the thermally conductive material can conduct heat to the Stirling engine 9 effectively. There is no limitation on the type of the fuel used in the scroll heating device 1. Various gaseous fuels, including those with a low heat value and difficult to burn directly, can be used, thus removing the conventional limitations on such low-heat-value fuels. Using this type of fuel helps achieve the objective of reusing energy in an effective manner. The gaseous fuel used in this embodiment (also referred to hereinafter as the fuel gas, or simply the gas) may be one or a combination selected from the group consisting of dimethyl ether (DME), methane ($CH_4$), synthesis gas (syngas), natural gas, liquefied petroleum gas, biogas, and gasified biomass energy. DME is readily available. For example, biomass gas extracted from biomass can be used to produce CO and $H_2$, which in turn can be processed into DME. DME is more portable than biomass gas, can be ignited with ease, and therefore has great potential as an alternative fuel.

Figure 4:
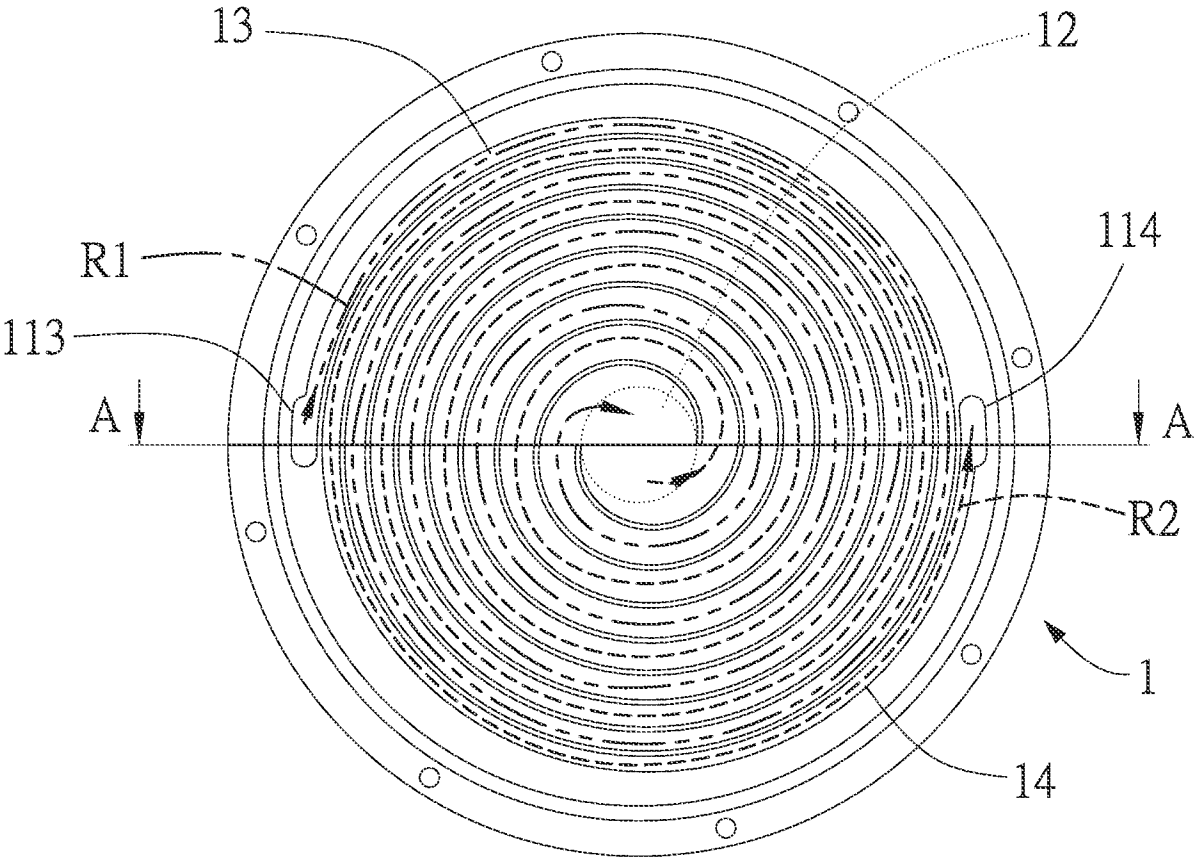
FIG. 4 shows the routes of an ingoing gas and of the outgoing exhaust in the scroll heating device in FIG. 1.
Figure 5:
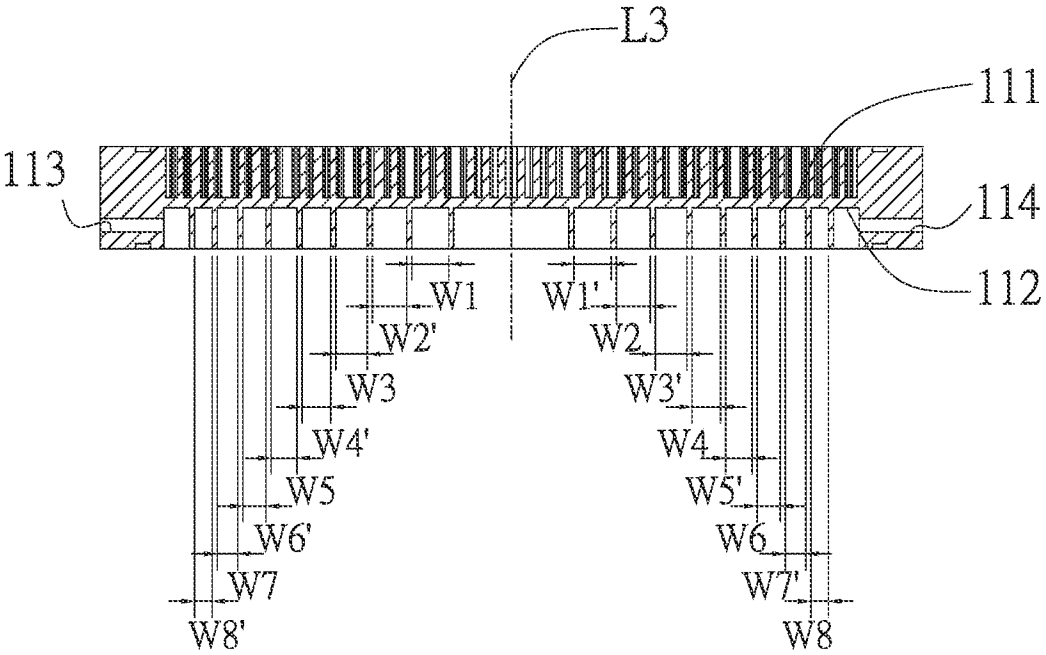
FIG. 5 is a sectional view taken along line A-A in FIG. 4.
Figure 6:
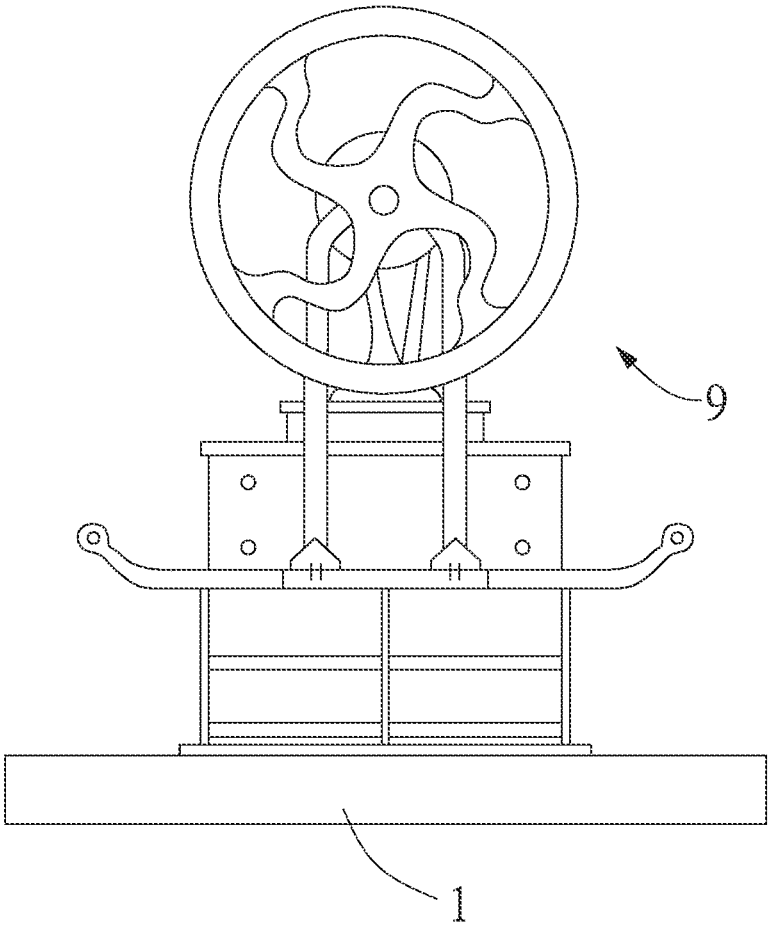
FIG. 6 shows how the scroll heating device in FIG. 1 and a Stirling engine are arranged with respect to each other.

Referring to FIGS. 4-6, the base 11 includes a first side 111, an opposite second side 112, a gas inlet 113 provided at the periphery of the base 11 and in communication with the first channel 13, and a gas outlet 114 provided at the periphery of the base 11 and in communication with the second channel 14. The gas inlet 113 and the gas outlet 114 are located diametrically opposite each other. The fuel gas, or an unburned, room-temperature mixed gas to begin with, is input into the scroll heating device 1 through the gas inlet 113. The combusted, high-temperature exhaust, on the other hand, flows out of the scroll heating device 1 through the gas outlet 114. The input of the unburned gas and the output of the exhaust take place simultaneously.

The base 11 defines a horizontal axis L1 that passes through the center point of the second side 112, a vertical axis L2 that is perpendicular to the horizontal axis L1 and passes through the center point of the base 11, and a center line L3 that penetrates the center point of the base 11.

In this embodiment, the Stirling engine 9 is located on the first side 111 of the base 11. The thickness between the first side 111 and the second side 112 is 3 mm; in other words, the base 11 has a thickness of 3 mm.

The reaction region 12 is located at the center of the base 11.

The first channel 13 is located on the second side 112 of the base 11 and extends outward of the reaction region 12. More specifically, the first channel 13 extends spirally from a starting point defined by the reaction region 12 toward the periphery of the base 11. The width W1-W8 of the first channel 13 is gradually reduced as the first channel 13 extends from a position adjacent to the center of the base 11 toward the periphery of the base 11, meaning the first channel 13 becomes narrower toward the outer end, i.e., toward the periphery of the base 11, and wider toward the inner end, i.e., toward the center of the base 11.

Similarly, the second channel 14 is located on the second side 112 of the base 11 and extends outward of the reaction region 12. More specifically, the second channel 14 extends spirally from a starting point defined by the reaction region 12 toward the periphery of the base 11. The width W1'-W8' of the second channel 14 is gradually reduced as the second channel 14 extends from a position adjacent to the center of the base 11 toward the periphery of the base 11, meaning the second channel 14 becomes narrower toward the outer end, i.e., toward the periphery of the base 11, and wider toward the inner end, i.e., toward the center of the base 11.

The first channel 13 has a first end 131 as its inner end, which is adjacent to the center of the base 11, and a second end 132 as its outer end, which is located away from the center of the base 11 and is connected to the gas inlet 113. The second channel 14 has a third end 141 as its inner end, which is adjacent to the center of the base 11, and a fourth end 142 as its outer end, which is located away from the center of the base 11 and is connected to the gas outlet 114.

The first channel 13 and the second channel 14 may be arranged according to one or a combination of a Fermat's spiral configuration, a Vogel spiral configuration, and an Archimedean spiral configuration. In this embodiment, the first and the second channels 13 and 14 are arranged according to a Fermat's spiral configuration.

More specifically, the width of the first channel 13 is gradually reduced from the center line L3 toward the periphery of the base 11, i.e., the width W1>the width W2>the width W3>the width W4>the width W5>the width W6>the width W7>the width W8, and the width of the second channel 14 is also gradually reduced from the center line L3 toward the periphery of the base 11, i.e., the width W1'>the width W2'>the width W3'>the width W4'>the width W5'>the width W6'>the width W7'>the width W8'.

Furthermore, taking the center line L3 as the reference line, the left portions of the first and the second channels 13 and 14 and the right portions of the first and the second channels 13 and 14 are symmetric in width, i.e., the widths W1 and W1' are the same, and so are the widths W2 and W2', the widths W3 and W3', the widths W4 and W4', the widths W5 and W5', the widths W6 and W6', the widths W7 and W7', and the widths W8 and W8'.

The first channel 13 and the second channel 14 are provided on the second side 112 in an alternate manner Therefore, the portion of the ingoing gas that is moving toward the reaction region 12 along the outermost turn of the route R1 will be preheated by the hot exhaust in the turn of the route R2 that is on one side of the outermost turn of the route R1, and the portion of the ingoing gas that is moving along the second outermost turn of the route R1 will be preheated by the hot exhaust in the turns of the route R2 that immediately flank the second outermost turn of the route RE Thus, the gas moving in the first channel 13 will be continuously preheated by the exhaust on both sides of the first channel 13 (or on one side of the first channel 13 when the gas flows through the outermost turn of the route R1) until the reaction region 12 is reached, and an enhanced gas preheating effect is achieved. In particular, the portion of the exhaust that is moving along the innermost turn of the route R2 toward the gas outlet 114 has the highest temperature because it has just left the reaction region 12 for the gas outlet 114, and can therefore boost the preheating effect and optimize the efficiency of heat cycling by preheating the gas that is about to enter the reaction region 12, thereby reducing unnecessary heat dissipation, exergy destruction, and the additional energy required to preheat the reactants. The combustibility of the reactants will also be enhanced as a result, making it possible to burn low-heat-value fuels.

The pin fins 15 are provided on the first side 111 and are spaced apart from one another to provide a plurality of contact surfaces and enhance a high convective heat transfer rate when heat is transferred through the contact surfaces to the working gas of the Stirling engine 9. The cover 16 is provided on the second side 112 to close the first and the second channels 13 and 14. As the thickness between the first side 111 and the second side 112 of the base 11 is merely 3 mm, and the first and the second channels 13 and 14 have outstanding heat transmitting and retaining abilities, heat can be transmitted from the gas in the first and the second channels 13 and 14 to the surfaces of the pin fins 15 rapidly. Thus, the aforementioned problem of the conventional heat exchangers, namely inefficient thermal conduction attributable to the limitations imposed on the mechanical structure and weight of a conventional heat exchanger, is solved. Furthermore, the scroll heating device 1 has a super thin design with an exceptionally high area/volume ratio, which increases the amount of heat that can be conducted.

When the fuel gas flows from the second end 132 of the first channel 13 (which end is located at the periphery of the base 11) toward the first end 131 (which is adjacent to the center of the base 11), the first channel 13, which gradually narrows toward the outer end (i.e., the second end 132) and gradually widens toward the inner end (i.e., the first end 131), allows the gas to flow toward the reaction region 12 at a progressively slower rate and then enter the reaction region 12 slowly through the gradually widening first channel 13. As the flow velocity of the gas is reduced, the time for which the gas can stay and burn in the reaction region 12 is increased. Moreover, the gas moving in the first channel 13 is continuously preheated by the exhaust on both sides of the first channel 13 (or on one side of the first channel 13 when the gas flows through the outermost turn of the first channel 13) such that the gas preheating time and effect is enhanced to enable complete combustion.

The combusted exhaust will flow into the third end 141 of the second channel 14 (which end is adjacent to the center of the base 11), exits through the fourth end 142 (which is located at the periphery of the base 11), and during the process transfers heat to the gas that is entering the reaction region 12. The scroll heating device 1, therefore, has both heat transmitting and heat retaining abilities. The preheating design of the heating device makes it possible to convert chemical energy stably into thermal energy and provide the Stirling engine 9, which works at atmospheric pressure, with a heat source that generates heat steadily through lean combustion.

In an experiment in which DME, methane, and syngas were used as the fuel gases, the scroll heating device 1 could drive the Stirling engine 9 to output electricity stably at 16 W when the base 11 was 3 mm thick, 10 W when the base 11 was 10 mm thick, and 6 W when the base 11 was 15 mm thick.

In addition, the heating device of the present invention includes activated aluminum oxide balls (which serve as a catalyst carrier) placed in the first and the second channels 13 and 14. The activated aluminum oxide balls are wet-plated with a platinum salt (as a catalyst) and calcinated on the surface so as to reduce the activation energy required for reactions, allowing low-temperature oxidation/reduction to take place continuously in the heating device. The catalyst is added with cerium(IV) oxide to increase the oxygen-carrying ability of the catalyst. As an oxygen ion-conducting oxide, cerium(IV) oxide can easily form cerium(III) oxide by releasing the oxygen atoms in the lattice to form oxygen vacancies, thus contributing to the completeness of reaction, enhancing the activity of the catalyst, encouraging a mixed gas of fuel and air to react completely in the heating device, and retaining heat to maintain the temperature of the scroll heating device 1.

Table 1 below shows the fuel equivalence ratios and thermoelectric conversion efficiencies of using DME, methane, and syngas for electricity output. As can be seen in the experiment data, DME is the fuel that had the highest combustion efficiency of 1.5%, and this is because DME has the highest energy density per unit volume and has similar properties to liquefied petroleum gas. DME can be pressurized at room temperature into a liquid state to facilitate transportation and storage, and is nowadays not only a notable alternative fuel for diesel engines, but also a substitute for liquefied petroleum gas for domestic use.

TABLE 1

| Fuel | DME | Methane | Syngas |
|---|---|---|---|
| Fuel equivalence ratio | 0.375 | 0.794 | 0.383 |
| Thermoelectric conversion efficiency (%) | 1.50 | 1.10 | 1.18 |

Thermal efficiency ($\eta_{th}$) was calculated by the second, using the following equation:

$$\eta_{th} = \frac{W_{out}}{Q_{in}}$$

$$\begin{cases} W_{out}: \text{work generated (the electricity output from the Stirling engine)} \\ Q_{in}: \text{total energy of the fuel} \end{cases}.$$

Figure 7:
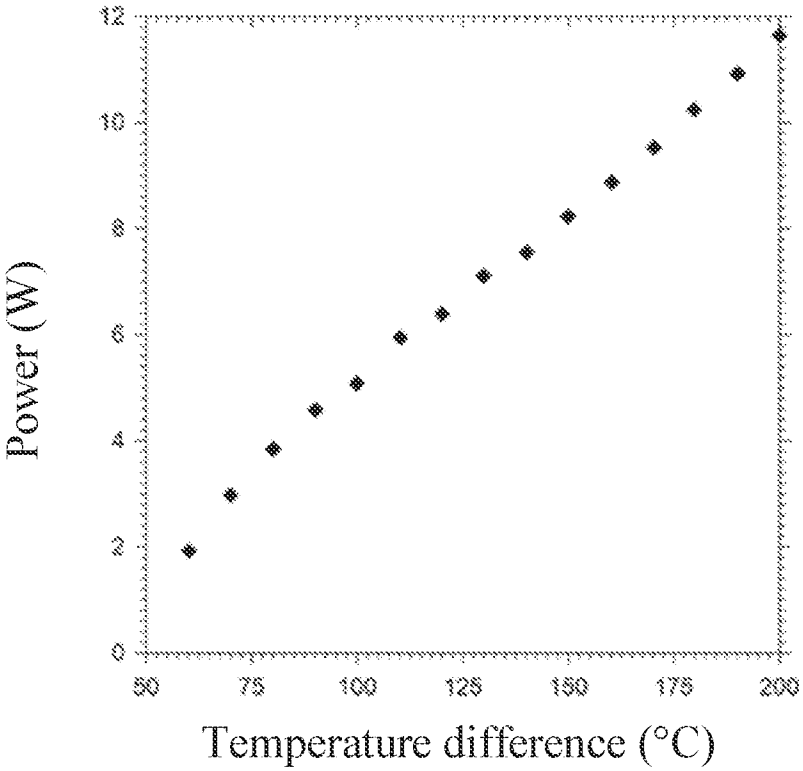
FIG. 7 is a plot showing various electricity output states of the scroll heating device-and-Stirling engine assembly in FIG. 6.

FIG. 7 shows the experiment result of using the Stirling engine 9 together with the scroll heating device 1 to output electricity, with the scroll heating device 1 coupled to the heating end of the Stirling engine 9 during the experiment. As can be known from the experiment result, the greater the temperature difference between the Stirling engine 9 and the scroll heating device 1, the greater the output power. The output power was about 12 W when the temperature difference was 200° C. The experiment result has shown that the scroll heating device 1 can be effectively coupled to the heating end of the Stirling engine 9 to increase heat transfer efficiency and thereby improve the performance of the Stirling engine 9 significantly.

The present invention can be used with various low-heat-value fuels. For example, the readily available biogas generated from pig farm wastes can be used to output energy by way of the invention. The biogas produced during the pig raising process is composed essentially of methane, and as demonstrated by the experiment mentioned above, in which methane was used as one of the fuel gases of the scroll heating device 1, the use of the methane-containing pig-farm biogas can help reduce the emission of greenhouse gases effectively. Pig farmers can use the electricity generated by the device of the invention to power the electrical appliances on the farm, without having to rely on the power supplied by an electrical grid; that is to say, the farmers will be able to generate electricity locally and therefore gain the advantage of self-sufficient power generation. Besides, power generation in a distributed manner can prevent energy loss attributable to long-distance electricity transmission, thereby reducing unnecessary loss of energy.

According to the above, the base 11, the reaction region 12, the first channel 13, the second channel 14, the pin fins 15, and the cover 16 of the scroll heating device 1 of the present invention are so configured and arranged that the first and the second channels 13 and 14 gradually narrow toward their respective outer ends and gradually widen toward their respective inner ends; that a gas moving through the first channel 13 to the reaction region 12 can be preheated by the exhaust in the immediately adjacent turns of the second channel 14 that flank the first channel 13; that the first channel 13, which gradually narrows toward its outer end and gradually widens toward its inner end, allows a gas flowing into the first channel 13 to flow toward the reaction region 12 at a progressively slower rate and then enter the reaction region 12 slowly through the gradually widening first channel 13, thereby increasing the duration of the combustion reaction of the gas; and that the portion of the exhaust that has just left the reaction region 12 and is moving through the second channel 14 toward the gas outlet 114 can preheat the portion of the ingoing gas that is about to enter the reaction region 12. The scroll heating device 1 not only transmits but also retains heat, and can reduce unnecessary heat dissipation and exergy destruction, allowing chemical energy to be converted into thermal energy stably. Also, the scroll heating device 1 has no limitation on the type of the fuel gas used, meaning the scroll heating device 1 can work with, and thereby remove the limitations conventionally imposed on, low-heat-value gases that are difficult to burn directly, making it possible to reuse energy effectively. Thus, the aforesaid objectives of the invention are achieved.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A scroll heating device, comprising:

a base;

a reaction region located at a center of the base; and a first channel and a second channel, both located on the base and extending outward of the reaction region, where each of the first channel and the second channel extends spirally from a starting point defined by the reaction region toward a periphery of the base, and each of the first channel and the second channel has a width that is gradually reduced as each channel extends from a position adjacent to the center of the base toward the periphery of the base, such that both the first channel and the second channel become narrower toward the periphery of the base and wider toward the center of the base;

wherein when a gas flows from a first end of the first channel that is located at the periphery of the base toward a second end of the first channel that is adjacent to the center of the base, the first channel allows the gas to flow toward the reaction region at a progressively slower rate and then enter the reaction region slowly through the first channel, which gradually widens toward the center of the base, thereby increasing a time for which the gas stays in the reaction region, and wherein a combusted exhaust flows into a third end of the second channel that is adjacent to the center of the base and exits through a fourth end of the second channel that is located at the periphery of the base.

2. The scroll heating device of claim 1, wherein the first channel and the second channel are arranged according to one or a combination of a Fermat's spiral configuration, a Vogel spiral configuration, and an Archimedean spiral configuration.

3. The scroll heating device of claim 2, wherein the base includes a gas inlet provided at the periphery of the base and in communication with the first channel and a gas outlet provided at the periphery of the base and in communication with the second channel, and the gas inlet and the gas outlet are located diametrically opposite each other.

4. The scroll heating device of claim 3, further comprising:

a plurality of pin fins, wherein the base further includes two opposite sides defined respectively as a first side and a second side, the pin fins are located on the first side and are spaced apart from one another, and the first channel and the second channel are located on the second side.

5. The scroll heating device of claim 4, further comprising:

a cover provided on the second side to close the first channel and the second channel.

6. The scroll heating device of claim 5, wherein the second end of the first channel is connected to the gas inlet, and the fourth end of the second channel is connected to the gas outlet.

7. The scroll heating device of claim 6, wherein the first side and the second side define therebetween a thickness of 3 mm.

8. The scroll heating device of claim 7, wherein the scroll heating device is made of a thermally conductive material, and the thermally conductive material is one or a combination selected from the group consisting of a metal, a metal alloy, and ceramic.

9. The scroll heating device of claim 8, wherein the gas is one or a combination selected from the group consisting of dimethyl ether (DME), methane ($CH_4$), synthesis gas (syngas), natural gas, liquefied petroleum gas, and biogas.

10. The scroll heating device of claim 1, wherein the scroll heating device is adapted for being coupled to a heating end of a Stirling engine.

* * * * *